US009315306B2

(12) United States Patent
Taber et al.

(10) Patent No.: US 9,315,306 B2
(45) Date of Patent: Apr. 19, 2016

(54) COMPOSITE CLOSURE

(71) Applicant: Silgan White Cap LLC, Downers Grove, IL (US)

(72) Inventors: James Taber, Aurora, IL (US); Kevin Orth, Des Plaines, IL (US)

(73) Assignee: SILGAN WHITE CAP LLC, Downers Grove, IL (US)

( * ) Notice: Subject to any disclaimer, the term of this patent is extended or adjusted under 35 U.S.C. 154(b) by 16 days.

(21) Appl. No.: 14/069,611

(22) Filed: Nov. 1, 2013

(65) Prior Publication Data

US 2015/0122769 A1 May 7, 2015

(51) Int. Cl.
*B65D 41/62* (2006.01)
*B65D 51/18* (2006.01)
*B65D 51/14* (2006.01)

(52) U.S. Cl.
CPC ..... *B65D 51/145* (2013.01)

(58) Field of Classification Search
CPC ..... B65D 51/145; B65D 41/3423; B65D 41/0442; B65D 41/045
USPC ..... 215/276, 349, 350
See application file for complete search history.

(56) References Cited

U.S. PATENT DOCUMENTS 4,121,729 A 10/1978 Husum
4,473,163 A 9/1984 Geiger
4,629,083 A 12/1986 Druitt
4,747,502 A 5/1988 Luenser
4,807,770 A 2/1989 Barriac
4,978,016 A 12/1990 Hayes
5,054,268 A 10/1991 Hayes et al.
5,285,913 A 2/1994 Morton
6,874,647 B2 4/2005 Bloom et al.
7,611,026 B1 11/2009 Bloom et al.
7,766,178 B2 8/2010 Robinson et al.
7,784,629 B2 8/2010 German et al.
8,071,004 B2 12/2011 Wan et al.
8,297,458 B2 10/2012 Sumimiya et al.
8,596,477 B2 12/2013 Kras et al.
2004/0149676 A1 * 8/2004 German et al. ..... 215/252

* cited by examiner

*Primary Examiner* — Fenn Mathew
*Assistant Examiner* — James N Smalley
(74) *Attorney, Agent, or Firm* — Cook Alex Ltd.

(57) ABSTRACT

A composite closure which includes an end panel that is received in a circular plastic fitment having a central opening therein defined by an inwardly extending flange which overlies an outer periphery of the end panel and an integral skirt downwardly depending from the flange. The fitment includes a radially inwardly extending circumferential bead or bead segments which include a substantially non-deformable flat vertical surfaces that are substantially parallel to the axis of the closure and axially positioned to contact the radial outermost edge of the end panel when the closure is fully applied to a container. The bead or bead segments are configured to impart a predetermined radial force on the end panel which produces a perceptible resistance upon initial rotation of the fully applied closure and provides assurance to a person removing the closure from the container that it has been fully applied to the container.

14 Claims, 8 Drawing Sheets

COMPOSITE CLOSURE

FIELD OF THE INVENTION

The present invention generally relates to composite closures and, more particularly, to composite closures having a plastic shell or fitment and a metal or plastic end panel having improved opening torque properties and characteristics.

BACKGROUND OF THE INVENTION

Composite closures are well known in the prior art and have commonly been used for a wide variety of products which are cold filled, hot filled or thermally pasteurized or sterilized after filling and closing. Typically, these closures include a metal end panel which can be pre-lined with a suitable sealing material such as, for example, a plastisol gasket material and then inserted or pressed into a preformed plastic (e.g., polypropylene) fitment or shell. A tamper indicating band, typically formed of a plastic material, is commonly secured to the lower portion of the skirt.

Prior art closures of this general type have been described in a number of patents including, for example, U.S. Pat. Nos. 7,784,629 and 7,175,039 each of which describe closure caps having a plastic shell and a metal end panel or insert disk having a curl on the outer periphery that is received in a plastic shell or fitment wherein the curl at the outer periphery of the end panel is contacted by a plurality of fins or gussets angularly (obliquely) disposed with respect to the longitudinal access of the closure cap. These fins or gussets exert a positive downward force on the curl end panel during initial opening of the closure and deform upon contact with the curl.

Correspondingly, U.S. Pat. No. 6,662,958 describes a composite closure with a metal insert disk or end panel that is received in a plastic shell or fitment having a continuous bead or bead segments that extend downwardly from a lower surface of the ring (flange) of the plastic shell. A contact surface on the continuous bead or circumferentially disposed bead segments (e.g., gussets) extend downwardly from a lower surface of the ring (flange) of the cap shell. The contact surface of these beads, bead segments or gussets is non-parallel to the longitudinal axis of the closure cap and, as such, exert a downward force on the curl.

U.S. Pat. No. 4,880,127 describes a composite closure having a plastic shell and metal insert which utilizes a curved bead or projection in the shell to contact the lower portion of a curl of a metal insert disk and, as such, exerts a positive axial force onto the disk during initial opening of the closure.

SUMMARY OF THE INVENTION

The present disclosure is directed to an improved composite closure which includes a circular plastic shell having a central opening defined by an inwardly extending circumferential flange and a downwardly depending skirt extending from that flange. A metal or plastic end panel is received in the shell, the upper outer peripheral surface of which is in intimate contact with the flange when the composite closure is fully applied to a container. The plastic shell includes an inwardly extending circumferential bead or bead segments that include a non-deformable flat vertical surface that is substantially parallel to the axis of the closure and axially positioned for contact with a radial outermost surface of the end panel when the closure is fully applied to the container. The bead or bead segments are sized so that the flat vertical contact surface thereof imparts a controlled radial force that provides a perceptible resistance upon rotation of the closure from its fully applied state which produces a disengagement torque (i.e., separation of the bead from the end panel outer edge) that provides assurance to a user that the composite closure has been properly sealed to the container. Additionally, this controlled radial force applied by the bead or bead segments to the peripheral surface of the end panel provides the closure with an anti-backoff feature. It prevents movement by the fitment with respect to the end panel and movement by the fitment and end panel assembly with respect to the container after the container is sealed and after further processing, if any.

DESCRIPTION OF THE DRAWINGS

In describing the preferred examples, reference is made to the accompanying drawing figures wherein like parts have like reference numerals and wherein.

DETAILED DESCRIPTION OF THE ILLUSTRATED EMBODIMENTS

Figure 1:
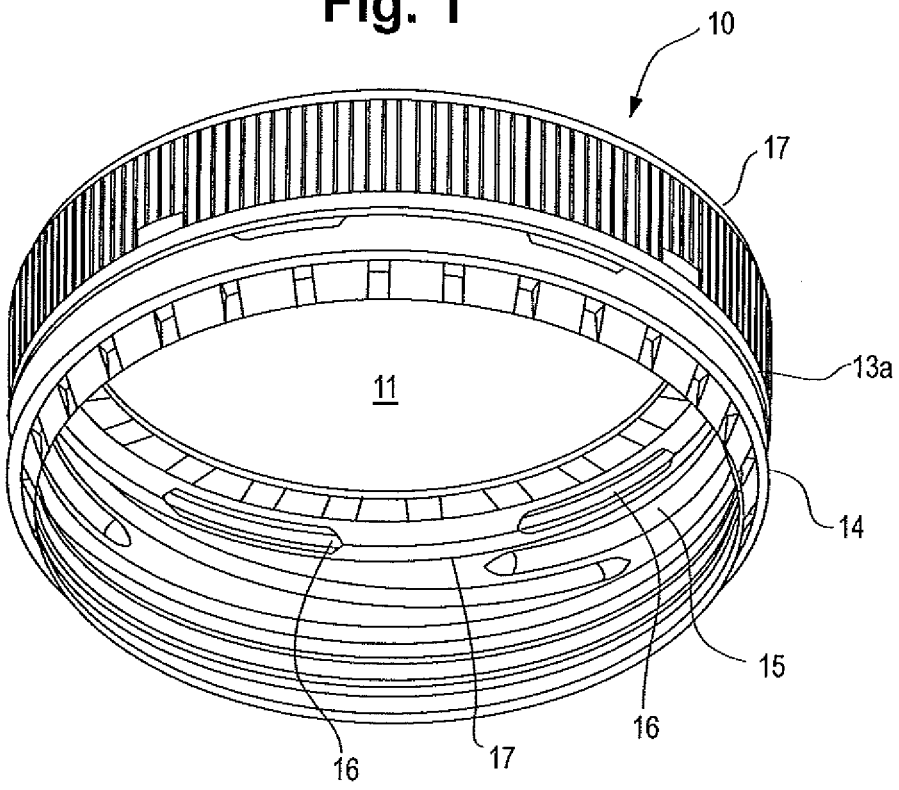
FIG. 1 is a bottom perspective view of a closure cap fitment of the present disclosure, shown without an insert disk.
Figure 2:
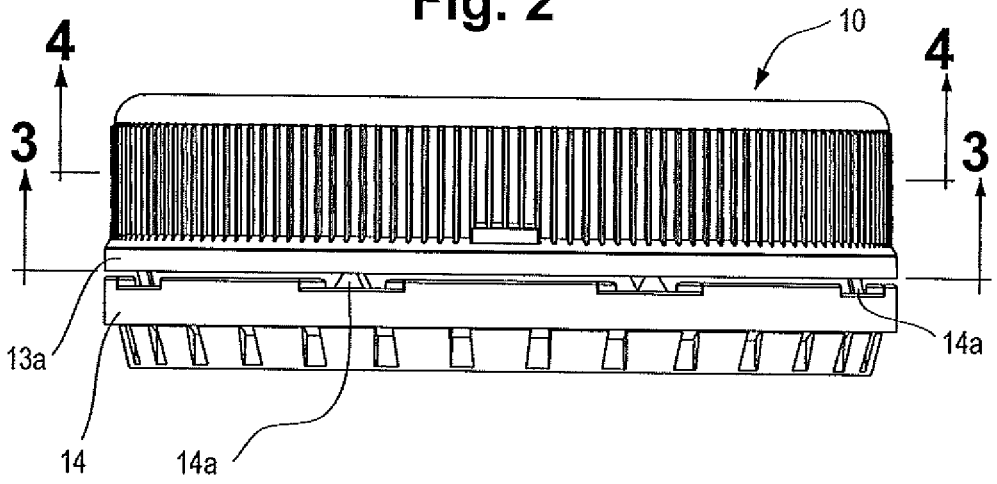
FIG. 2 is a side elevational view of the closure cap fitment of FIG. 1.

Referring to the drawings and, in particular, to FIGS. 1-6, a closure cap fitment of the present disclosure is generally designated by the reference numeral 10. As best shown in FIGS. 1 and 3-6, the fitment includes a central opening 11 defined an inner circumferential edge of a flange 12 that extends into an annular sidewall 13. A tamper indicating band 14 is integrally formed with, and interconnected to, a lower portion 13*a* of sidewall 13 by a plurality of circumferentially disposed fracturable bridges 14*a*. Tamper indicating band 14 can be of any well known design such as, for example, that shown and described in U.S. Pat. No. 4,981,230 and includes a plurality of drain holes 14*b*. Fitment 10 which can be composed of suitable thermoplastic resins well known to those skilled in the art, including, for example, propylene homopolymers and copolymers.

The inner circumferential surface of skirt 13 is provided with a plurality of preformed threads 15 for cooperative engagement with the outer threads on a container neck to which the closure will be applied. In the illustrated embodiment, the threads 15 are of a multi-lead design for improved cap application and removal. If desired, however, a single lead thread design could be used.

Figure 4:
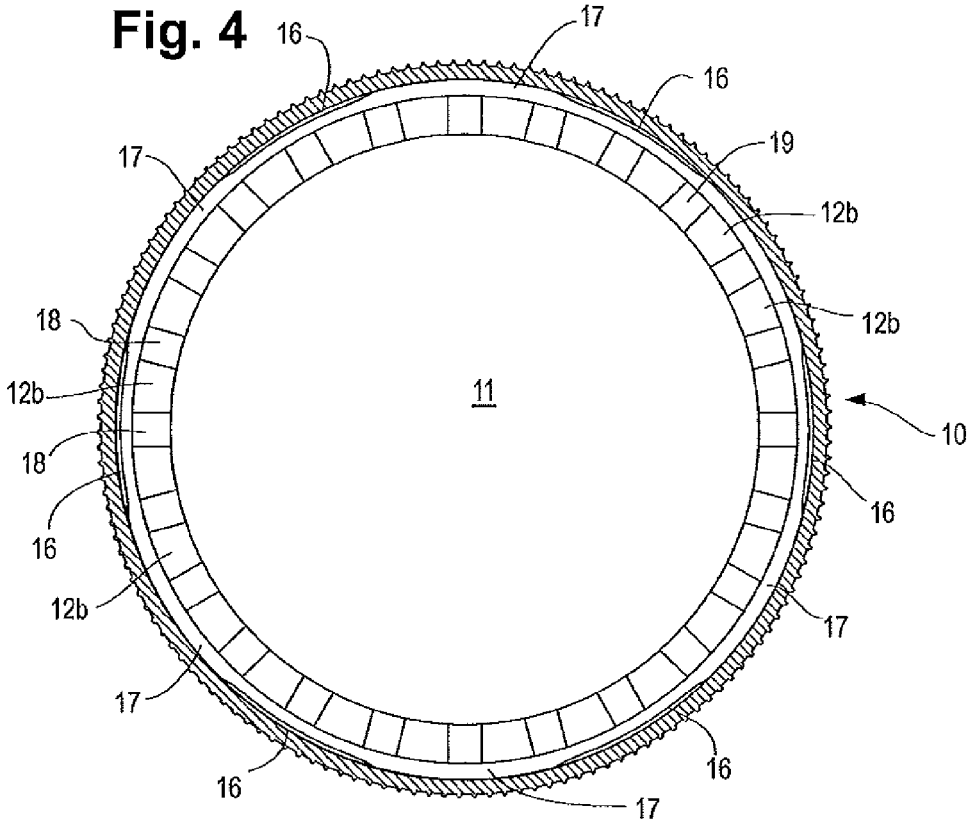
FIG. 4 is a bottom view of the closure cap fitment shown in FIGS. 1 and 2 taken along the line B-B of FIG. 2.
Figure 5:
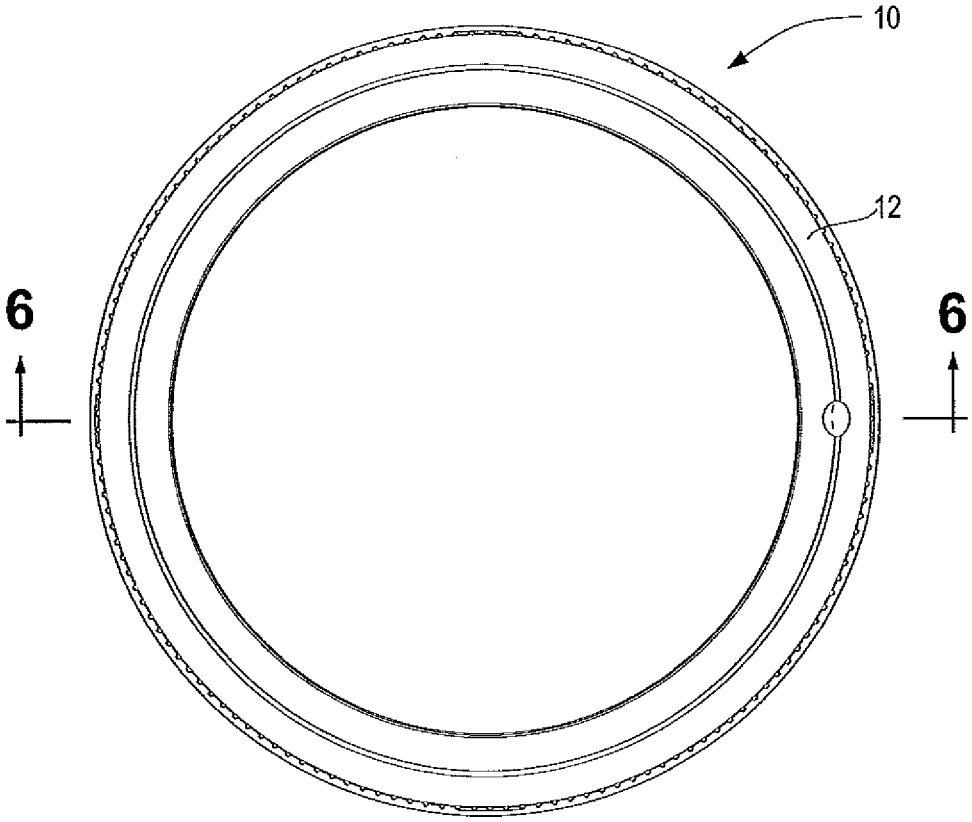
FIG. 5 is a top plan view of the closure cap fitment of FIGS. 1 and 2, shown without the end panel disk insert.
Figure 6:
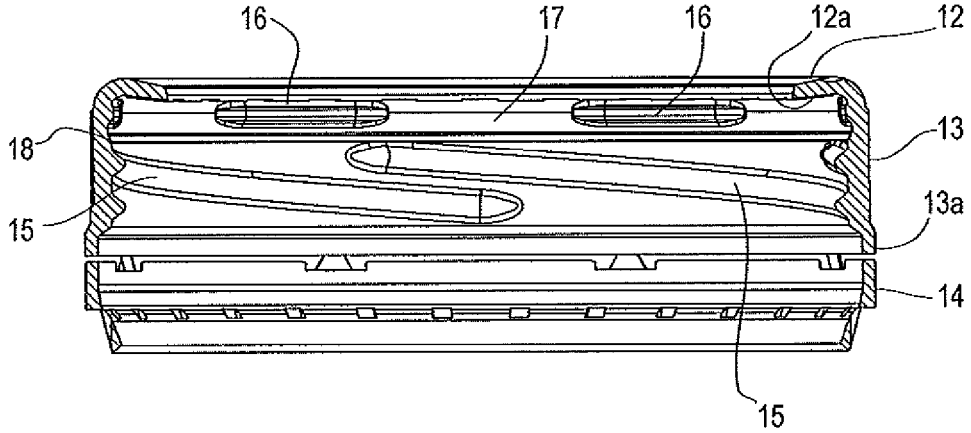
FIG. 6 is a sectional view taken along the line C-C of FIG. 5.

In accordance with an important aspect of the present disclosure, circumferential bead segments 16 are integrally formed with sidewall 13 and project radially inwardly from the inner surface of the sidewall at a location that is axially above the threads 15 for direct contact with an outermost surface of an end panel that is received within the fitment. In the illustrated embodiment and as best shown in FIGS. 1, 4 and 6, each of six bead segments 16 are separated by circumferential spaces 17. It will be appreciated, however, that the individual separated bead segments 16 could be replaced by a continuous circumferential bead or by a greater or lesser number of bead segments. The use of multiple bead segments which are uniformly spaced around the inner circumference of the skirt 13 serve to provide a substantially uniform, rounded outer circumference of the closure cap sidewall when fully applied to a container. Both a continuous circumferential bead or plurality of equally spaced circumferential bead segments are all characterized by a substantially non-deformable flat vertical surface that is substantially parallel to the axis of the closure fitment.

Figure 3:
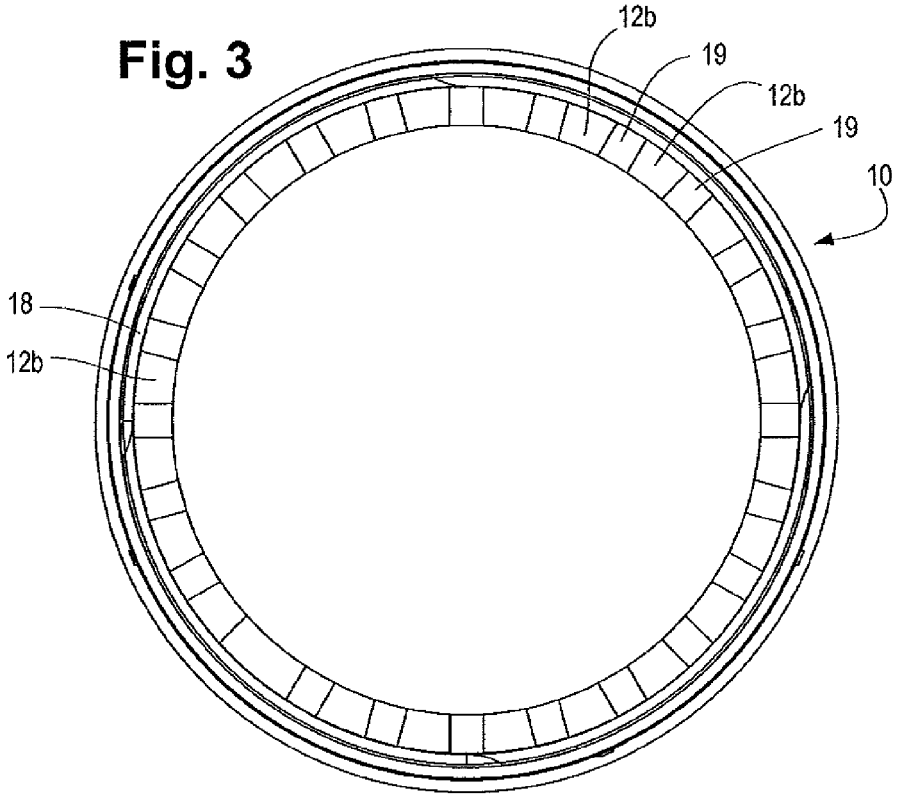
FIG. 3 is a bottom view of the closure cap fitment of FIGS. 1 and 2, shown without the end panel disk, taken along the section line A-A of FIG. 2.

As shown in FIGS. 3 and 4, the closure cap fitment 10 includes a plurality of spaced, radially extending vents 18 along the bottom surface 12*a* of flange 12. Vents 18 provide flow channels for draining liquid (water) used to cool or rinse the package are spaced apart by downwardly projecting portions 12*b* on the undersurface 12*a* of flange 12.

Figure 7:
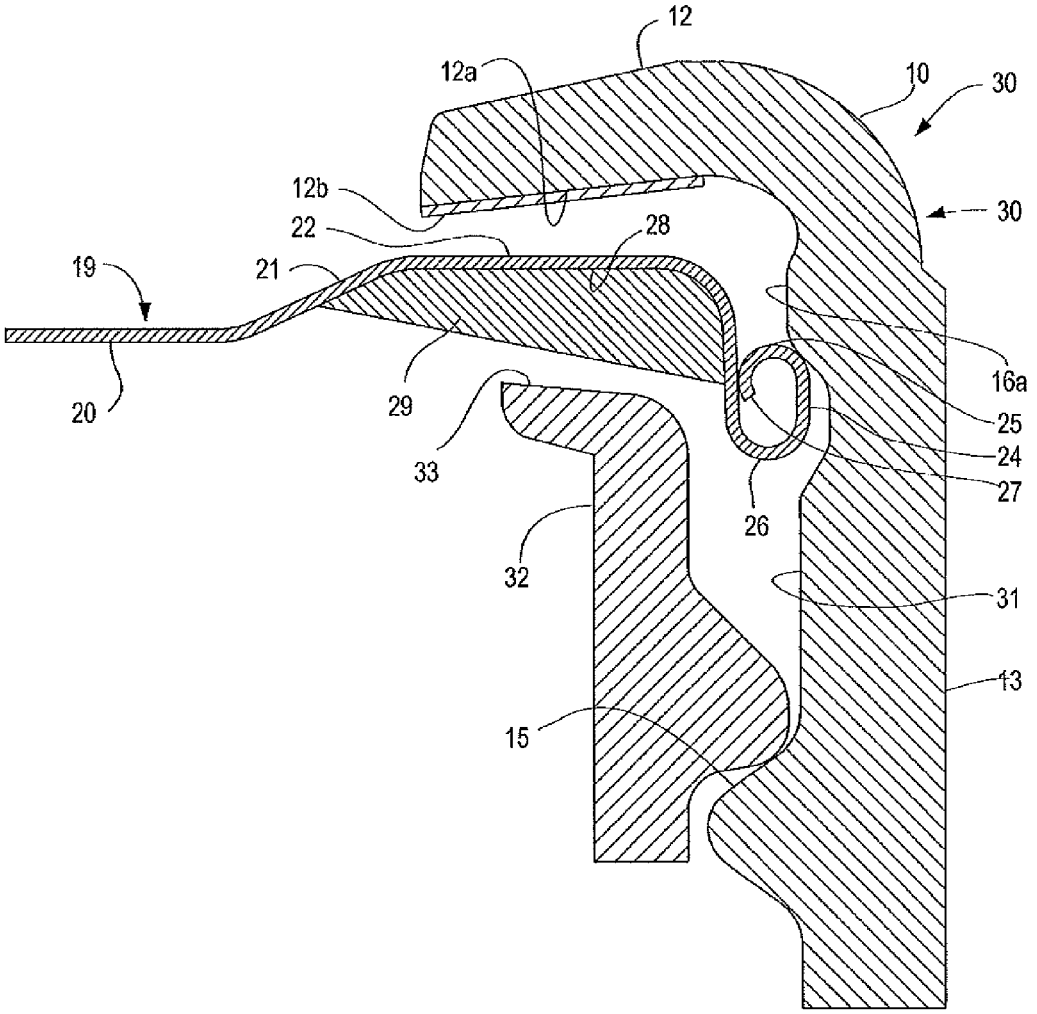
FIG. 7 is a partial longitudinal sectional view of a composite closure cap and container assembly of the present disclosure shown with the end panel in a loose position.
Figure 8:
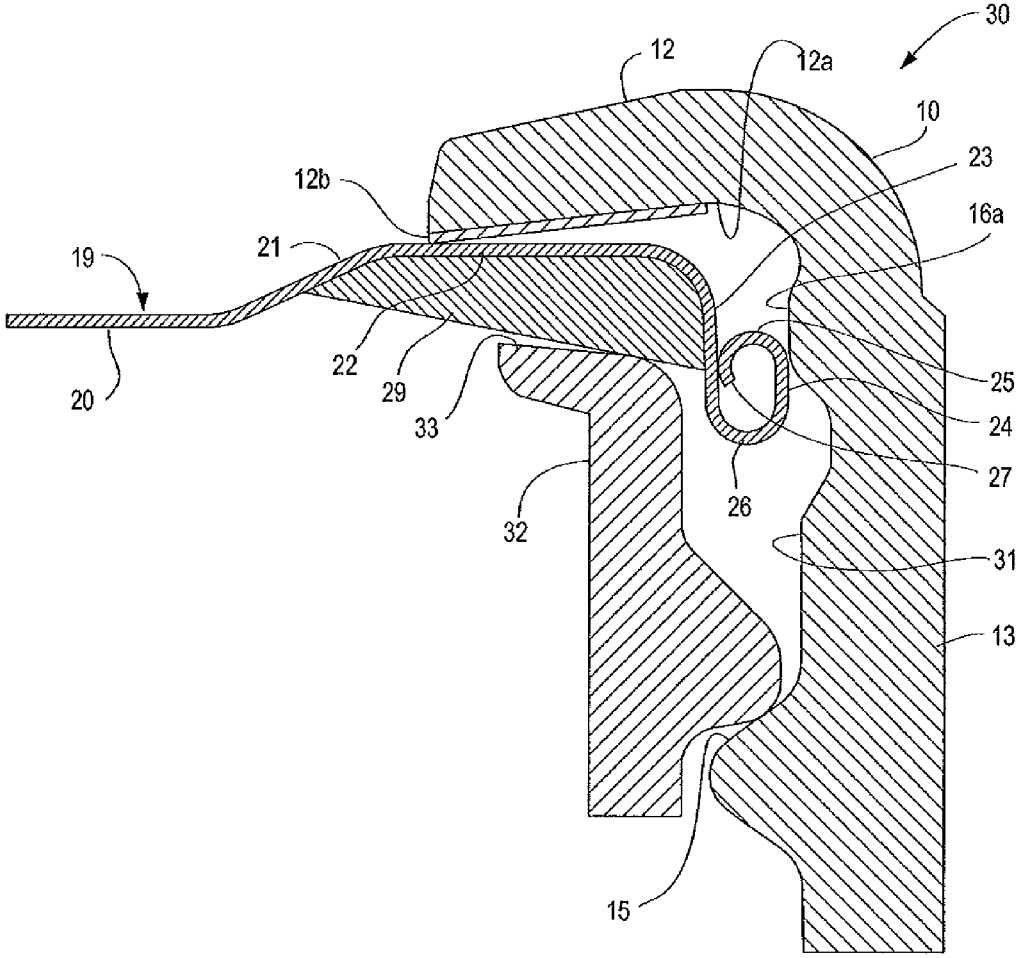
FIG. 8 is a partial longitudinal cross-sectional view of a composite closure cap and container assembly of the present disclosure with the end panel shown in an intermediate position.
Figure 9:
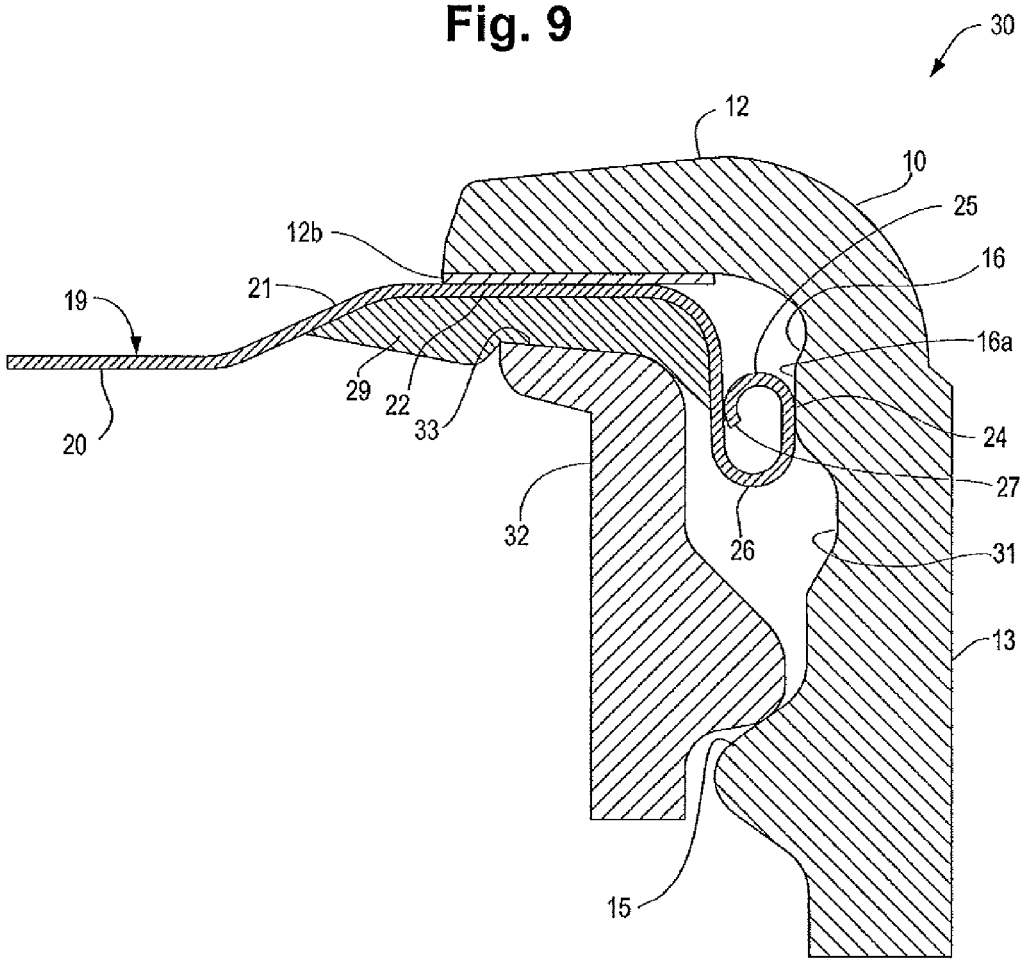
FIG. 9 is a partial longitudinal cross-sectional view of a composite closure cap and container assembly of the present disclosure with the composite closure cap shown in a fully tightened position.

FIGS. 7-9 partially illustrate an end panel 20 in association with the fitment 10 in loose (FIG. 7), intermediate (FIG. 8) and fully tightened (FIG. 9) positions at a representative circumferential location wherein a bead segment 16 is present. Preferably end panel 19 can be formed of metal, however, other materials known in the art exhibiting suitable oxygen barrier properties can also be used. End panel 19 includes a center portion 20 that extends radially outwardly into an upwardly and outwardly inclined surface 21, an annular flat surface 22, and an axially downwardly extending portion 23 that terminates in a curl 24 which includes an upper curved surface 25 and a bottom curved surface 26. As shown, the raw cut edge 27 of the end panel is not exposed. The underside surfaces of sloped portion 21, annular flat portion 22 and axially downwardly extending portion 23 of the end panel define a channel 28 in which a resilient material such as a plastisol can be deposited to form a suitable sealing gasket 29 for sealing with an end finish of a container to which the composite closure formed by fitment 10 and end panel 19 (collectively identified by the reference numeral 30) is applied.

As best shown in each of FIGS. 8, 9, 10 and 11, a retaining bead 31 extends radially inwardly from the inner surface of the sidewall 13 serves to retain the end panel in the fitment. Additionally, retaining bead 31 also serves to provide a lifting action on the end panel during removal of a closure cap from a container. If desired, retaining bead 31 can be omitted and the closure 30 with a top surface of the uppermost thread 15 configured such that it both serves to both retain the disk 19 from being inadvertently separated from the fitment 10 prior to application of a composite closure assembly 30 to a container and also to perform the function of lifting the end panel from a sealed end finish of a container to which the composite closure is applied.

The contact beads 16 include a substantially non-deformable flat vertical surface 16*a* which is parallel to the longitudinal axis of the container and axially positioned so that it is in interference fit contact with the outermost portion of the end panel, i.e., the curl 24 in the embodiment of FIGS. 7-11 when the closure is fully applied and tightened as shown in FIG. 9. The contact bead flat surface 16*a* imparts a limited predetermined radial (without significant axial) force on the outwardmost surface of the curl 24 to provide a readily perceptible resistance (e.g., approximately 10 to 30 inch pounds with 63 mm closures) upon initial rotation of the closure from its fully applied state and give assurance to a user that the composite closure was fully applied and sealed on the container prior to that initial rotation.

As shown in FIG. 7, in the loose position, the end panel 19 is schematically depicted in the space between the bottom surface 12*a* of fitment 10 and end finish 33 of a container 32. In this position, the curl 24 is located below the flat vertical surface 16*a* of contact bead 16. The intermediate position depicted in FIG. 8 shows the end finish 33 in initial contact with the gasket 29 and the annular flat surface 22 of end panel 19 in initial contact with the vent-defining portion 12*b* of flange 12. In this position, the radial outermost portion of curl 24 is in initial contact with the flat vertical surface 16*a* of contact bead 16. In the fully tightened position, the composite closure 30 is fully seated on the container end finish 33 and the vertical flat surface 16*a* is in an interference fit with the curl 24, applying a radial force (without any significant axial component) to the curl.

Figure 10:
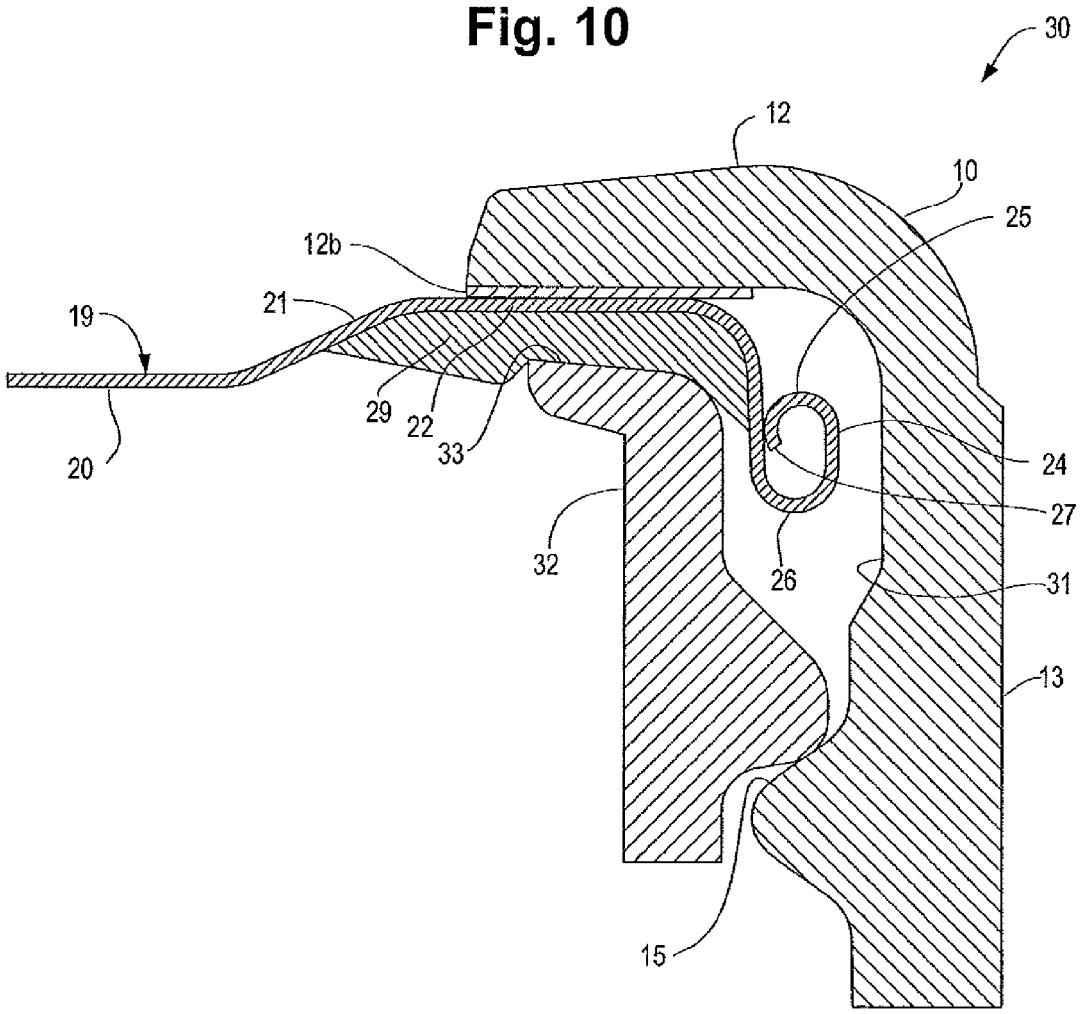
FIG. 10 is a partial longitudinal sectional view of a composite closure and container assembly of the present disclosure with the composite closure shown in a fully tightened position at a circumferential location between adjacent individual bead segments.

FIG. 10 depicts another circumferential location of the fully tightened closure shown in FIG. 9 which corresponds to the open space 17 between bead segments 16. As shown, there is no contact between the curl and the inside wall of fitment 13 in this location.

Figure 11:
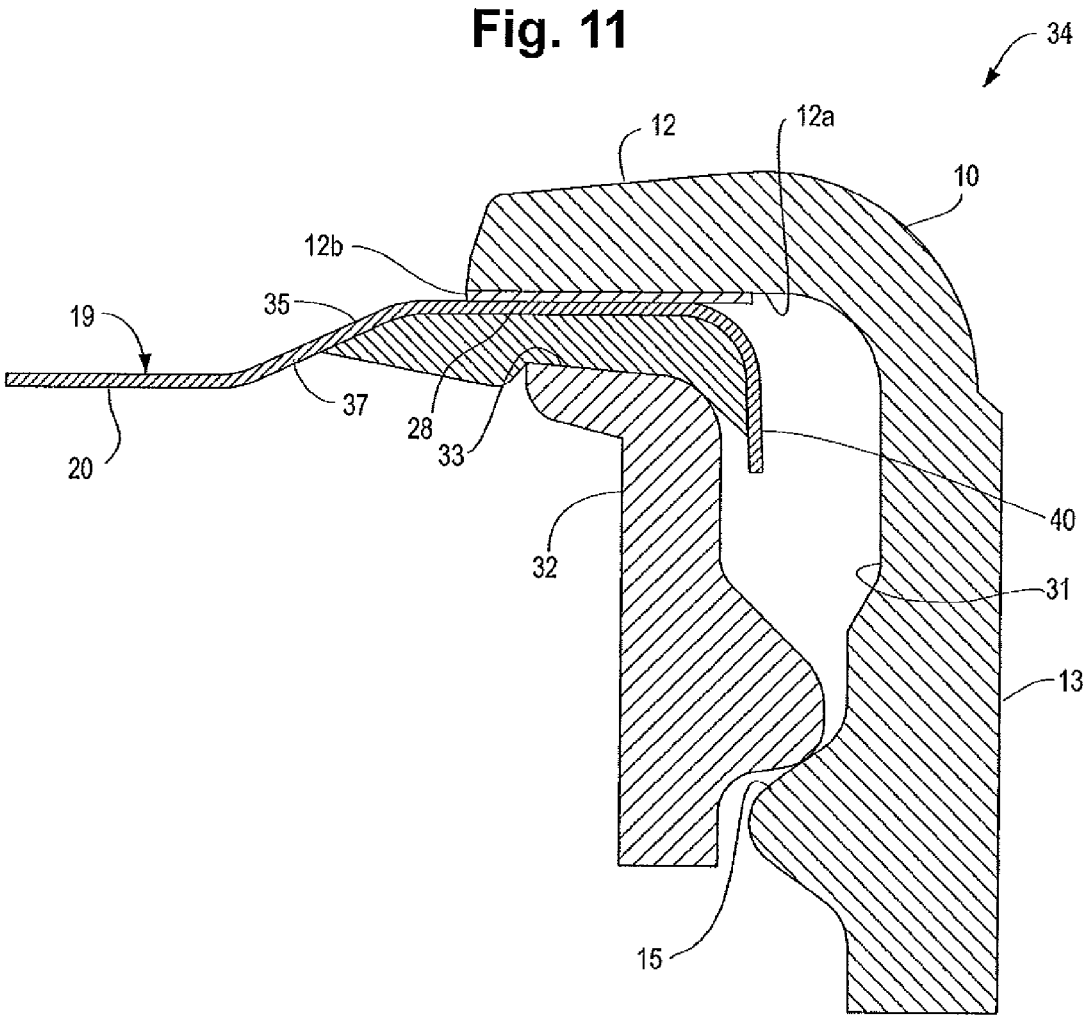
FIG. 11 is a partial longitudinal cross-sectional view of a composite closure cap of another embodiment of this disclosure with the composite closure cap shown in a fully tightened position.

FIG. 11 depicts another embodiment of the present invention in which a composite closure 34 having a fitment 10 identical to that of the previous embodiment is shown. A modified insert disk 35 is shown which includes a center portion 36, inclined surface 37, and annular surface 38 which respectively correspond to previously described portions 20, 21 and 22 of the first embodiment. The annular flat surface 38 of this embodiment extends axially downwardly into a flat (uncurled) surface 40. As such, the flat vertical surface 16*a* of bead segments 16 is in full contact with the outer surface 40 of the insert disk 35. As shown, the flat vertical surface 16*a* of the contact bead imparts a radial force on flat (uncurled) surface of the disk 35, thereby providing the desired readily perceptible resistance upon initial rotation of the closure cap during its removal from the container 32 and the benefits associated therewith as previously described.

While the invention of this disclosure has been described with illustrative examples, it will be appreciated that modifications and/or changes may be made by those skilled in the art without departing from the spirit and scope of the invention as defined by the appended claims.

We claim:

1. A composite closure for a container, said composite closure comprising:

a circular plastic fitment having a central opening defined by an inwardly extending circumferential flange and a downwardly depending skirt extending from said flange;

an end panel received in said fitment, an upper, outer peripheral surface of said panel underlying a bottom surface of said flange and in intimate contact therewith when said composite closure is fully applied to a container;

said skirt of said plastic fitment including a radially inwardly extending circumferential contact bead that includes a substantially non-deformable vertically flat surface in cross-section that is substantially parallel to a vertical axis of said closure and axially positioned for contact with a radial outermost surface of said end panel when said closure is fully applied to said container, said bead being sized so that the vertical contact surface thereof imparts a predetermined radial force on said radial outermost surface of said end panel which produces a perceptible resistance upon initial rotation of said closure from its fully applied state and provides assurance to a user that said composite closure has been fully applied to the container prior to said initial rotation.

2. The composite closure of claim 1 wherein said end panel is metal.

3. The composite closure of claim 2 wherein said radial outermost surface of said end panel includes an arcuate curl.

4. The composite closure of claim 3 wherein said bead is in the form of a plurality of circumferential individual segments.

5. The composite closure of claim 4 wherein said segments are uniformly spaced around the inner circumference of said plastic shell.

6. The composite closure of claim 1 wherein said circular plastic fitment is composed of a propylene polymer.

7. The composite closure of claim 1 wherein said initial rotation produces a disengagement of the contact bead from the radial outermost surface of the end panel.

8. The composite closure of claim 7 wherein the torque force to produce said disengagement is from approximately 10 to 30 inch pounds.

9. A composite closure and container package, comprising:

a container having a neck with container threads formed on an outer surface thereof, said neck including an end surface defining an open mouth of said container;

a circular plastic fitment having a central opening therein defined by an inwardly extending circumferential flange and a depending skirt extending downwardly from said flange;

a circular end panel received in said shell, said end panel including a circumferential, downwardly facing channel in which a resilient composition is contained for forming a seal with the end surface of said container neck;

an upper, outer peripheral surface of said end panel underlying said flange which is in intimate contact with a bottom surface thereof when said composite closure is fully applied to said container, the outer peripheral edge of said end panel terminating in an arcuate curl;

said skirt of said plastic fitment including a radially, inwardly extending circumferential bead that includes a substantially non-deformable, vertically flat surface in cross-section that is substantially parallel to a vertical axis of said container and axially positioned for contact with said curl, said flat vertical surface of said bead being in its as-molded shape, without deformation as a result of its contact with said curl;

said bead being sized and configured so that the flat vertical surface of said bead imparts selected predetermined radial force which imparts a perceptible resistance upon initial rotation of said closure while fully applied to said container so as to provide a user with assurance upon rotation of said closure that it was fully applied to said container prior to said initial rotation.

10. The composite closure and container package of claim 9 wherein said bead is in the form of a plurality of circumferential spaced-apart individual segments.

11. The composite closure and container package of claim 10 wherein said individual bead segments are generally uniformly spaced around the inner circumference of said plastic shell.

12. The composite closure of claim 9 wherein said circular plastic fitment is composed of a propylene polymer.

13. The composite closure of claim 9 wherein perceptible resistance upon initial rotation of said closure produces a disengagement of the contact bear from the curl of said end panel.

14. The composite closure of claim 13 wherein the torque force to produce said disengagement is from approximately 10 to 30 inch pounds.

* * * * *